United States Patent [19]

Gonnai et al.

[11] 4,111,140

[45] Sep. 5, 1978

[54] THREAD TENSIONING DEVICE FOR A SEWING MACHINE

[75] Inventors: Tohru Gonnai; Chikao Yamashita, both of Nagoya, Japan

[73] Assignee: Brother Kogyo Kabushiki Kaisha, Nagoya, Japan

[21] Appl. No.: 703,380

[22] Filed: Jul. 8, 1976

[30] Foreign Application Priority Data

Jul. 8, 1975 [JP] Japan ..... 50-83673

[51] Int. Cl.[2] ..... D05B 47/04; D05B 47/02

[52] U.S. Cl. ..... 112/254

[58] Field of Search ..... 112/238, 254, 255, 59, 112/97; 139/216; 242/149

[56] References Cited

U.S. PATENT DOCUMENTS

| | | | |
|---|---|---|---|
| 257,052 | 4/1882 | Neilly | 112/254 |
| 1,026,298 | 5/1912 | Blanchard | 139/216 |
| 2,021,946 | 11/1935 | Riely | 242/149 |
| 3,347,195 | 10/1967 | Gegauf | 112/254 |

*Primary Examiner*—Peter Nerbun

*Attorney, Agent, or Firm*—Browdy and Neimark

[57] ABSTRACT

A thread tensioning device for a sewing machine including a pair of elongated plate members closely confronted with each other by a spring member, disposed in the path of a thread, for forming a substantially wedge-shaped and extremely narrow gap therebetween which extends along the thread path, whereby the device can impart a thread passing through the narrow gap between the two plate members a certain tension suitable for the sewing without any manual operation, because the resistance acting on the passing thread is automatically determined in response to the size thereof.

10 Claims, 16 Drawing Figures

THREAD TENSIONING DEVICE FOR A SEWING MACHINE

BACKGROUND OF THE INVENTION

The present invention relates to a thread tensioning device for a sewing machine. For well-known thread tensioning devices used in the conventional sewing machines it is next to impossible to automatically change the tension imparted to the thread leading from a supply of thread to a stitch-forming instrumentality, such as a needle, when the size or thickness of the thread is changed on replacement thereof. For forming a good-looking stitch wherein upper and lower threads are so well balanced in tension that the concatenation thereof is set at the midway point between the upper and lower faces of the work pieces, the tensioning device must be manually operated to appropriately adjust the tension to be imparted to the thread whenever the same is replaced.

The adjustment of tension inevitably requires a trial sewing, which is time-consuming even for skilled operators, and is cumbersome for unskilled beginners beyond description. Simplification of this tension adjustment, which will naturally lead to a simplification of machine operation and forming of good-looking stitches, has been an essential problem in this field to be solved yet.

SUMMARY OF THE INVENTION

The present invention has been completed after a variety of experimental sewings, considering the above-mentioned circumstances. A primary object of this invention is, therefore, to provide a well adapted thread tensioning device, having completely eliminated the traditional disadvantages, which enables an operator to easily form good-looking stitches without any manual operation.

Another object of this invention is to provide a thread tensioning device wherein a thread passing therethrough is in response to the size or thickness of the thread automatically imparted an appropriate tension for forming a good-looking stitch.

In a preferable embodiment of this invention, the thread tensioning device comprises a pair of elongated plate members, disposed within a machine frame, closely confronting with each other under a concentratedly acting spring force, thread guide means for guiding the thread drawn out of a supply of thread to be passed between both plate members substantially along the longitudinal direction thereof, and gap forming means for forming a substantially wedge-shaped gap between both plate members in a manner such that the gap extending along the path of the thread diverges toward the side of the thread supply and at the same time extending also in the direction approximately normal to the thread path converges toward the outside of the machine frame than the thread path. The above-mentioned structure permits the thread to smoothly pass through the gap between both plate members along a constant path.

Still another object of this invention is, therefore, to provide a thread tensioning device wherein the thread passing the device is automatically imparted a suitable tension for sewing in response to the size or thickness thereof and, in addition, the thread can not slip out of the device while the machine is operating.

Skilled operators of the sewing machine sometimes wish to make a special stitch, for example, in which a lower thread be purposely drawn out by an upper thread onto the upper surface of the work piece; in such a case the thread tensioning device needs to be operated for imparting the upper thread a far greater tension than that of the lower thread.

A further object of this invention is consequently to provide a thread tensioning device in which normally a well balanced tension with that of a lower thread is automatically imparted to an upper thread in response to the thickness thereof but an operator may optionally adjust the tension of the upper thread, in case of need, easily just likewise in the conventional sewing machines.

For this purpose, there is disposed in the machine frame a manually operable means which is normally covered with a cover but can be easily accessible or operable, when necessary, by opening the cover.

DESCRIPTION OF THE DRAWING

Drawings are to show an embodiment wherein the present invention is realized in an upper thread tensioning device for household sewing machines, in which.

DETAILED DESCRIPTION OF THE PREFERRED EMBODIMENT

Figure 2:
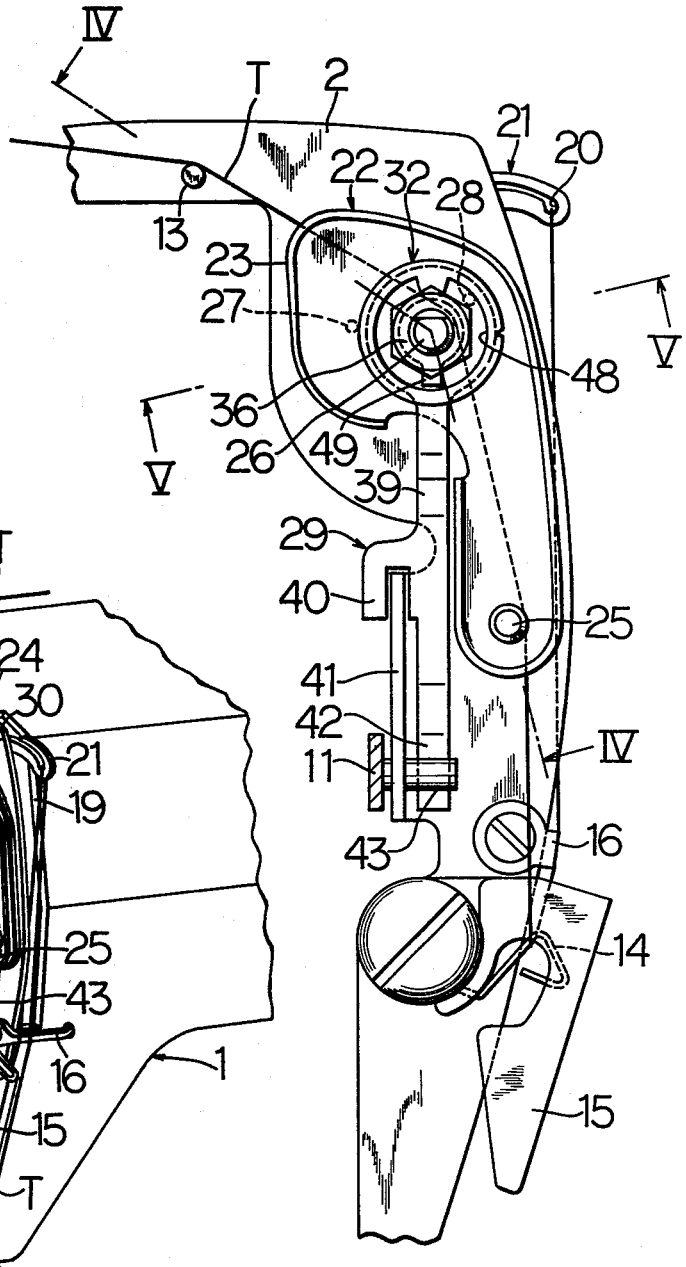
FIG. 2 is a front elevation view of the upper thread tensioning device.

A hollow arm 1, which mainly constitutes a machine frame together with a later described cover plate 3, is provided with an opening on the left end (in FIG. 1), whereto is secured an attaching plate 2 on which the cover plate 3 is openably attached to cover the opening. Inside the cover plate 3 are disposed a well-known needle bar 5 carrying a needle 4, as one of stitch forming instrumentalities, at the lower end thereof and performing an endwise reciprocation and a lateral oscillation in timed relation with a main shaft of the machine (not shown) as well as a presser bar 8 having a secured presser foot 6 at the lower end thereof and being constantly biased downwards by the action of a compression spring 7. A presser bar lifting lever 9 includes a known cam portion (not shown) confronting from beneath to a lug of a block 10, firmly fixed to the presser bar 8, via an actuating arm 11 whose function will be later described. When the lever 9 is turned upwards the presser bar 8 is lifted up against the action of the compression spring 7. On the attaching plate 2 are firmly mounted, for guiding a thread T drawn out from a supply of upper thread in order, a first thread guide 12, a guide pin 13, a second thread guide 15 including a check spring 14, a guide piece 16, and a third thread guide 17.

In addition, at the lower end of the needle bar 5 is secured a fourth thread guide 18 together with the needle 4; between the left end of the hollow arm 1 (in FIG. 1) in front side thereof and the attaching plate 2 is formed a slot 19 to provide a passage for vertical reciprocation of a take-up lever 21, the tip of which includes a thread retaining eye 20 projecting outwards through said slot.

The numeral 22 denotes the upper thread tensioning device in accordance with this invention disposed in an upper thread passing route, detailed description thereof will be deployed hereinunder referring to FIGS. 2 through 5. A pair of elongated plate members 23, 24, each peripheral edge thereof being bent in the direction away from each other, are loosely fitted respectively at the lower portion thereof onto a pin 25 secured to the attaching plate 2. The plate member 24 adjacent to the attaching plate 2 is secured thereto, with the peripheral edge thereof being abutted on the attaching plate 2, with a supporting shaft 26 fixed on the attaching plate 2; the other plate member 23 being likewise loosely fitted also on the supporting shaft 26 is consequently movable in the axial direction guided by both the supporting shaft 26 and the pin 25. Both confronting surfaces of plate members 23, 24 are smoothly finished. On the inner surface of the movable plate member 23 are disposed a pair of (pointed) projections 27, 28 confrontation with the fixed plate member 24 with different amount of projection in a manner such that each point thereof is located in a plane normal to the plane including the axis of the supporting shaft 26 and the axis of the pin 25, and located a little above the supporting shaft 26. And one projection 27 located at relatively inner side is a little larger in the projection amount than the other 28 located at relatively outer side.

On the supporting shaft 26 are retained respectively an actuating arm 29 concurrently serving as a spring receiver, a biasing means such as a compression spring 30, a slider 31, a regulating knob 32, and a stopping 33, all of these being retained there by a pair of nuts 35, 36 which are meshed with a screw groove 34 formed on the free end of the supporting shaft 26, in order not to be gotten out of the supporting shaft 26. On the actuating arm 29, the upper end thereof being fitted on the supporting shaft 26, are formed a pair of projections 37, 38, as shown in FIG. 5, in a manner such that each point thereof is located in a plane which includes the axis of the supporting shaft 26 and is normal to the plane including the same axis and the axis of the pin 25; via these projections 37, 38 the spring force of the compression spring 30 concentratedly acts on the movable plate member 23 to render the same 23 closely confronted with the fixed plate member 24.

Figure 1:
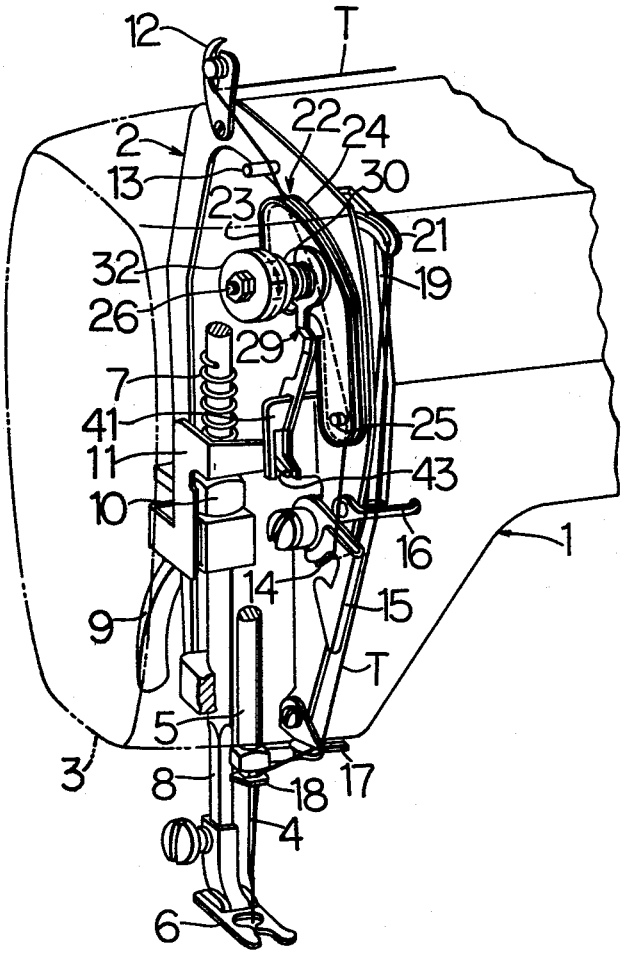
FIG. 1 is a perspective view for explaining the outline of the embodiment in relation to other machine parts, with the cover plate being removed.
Figure 3:
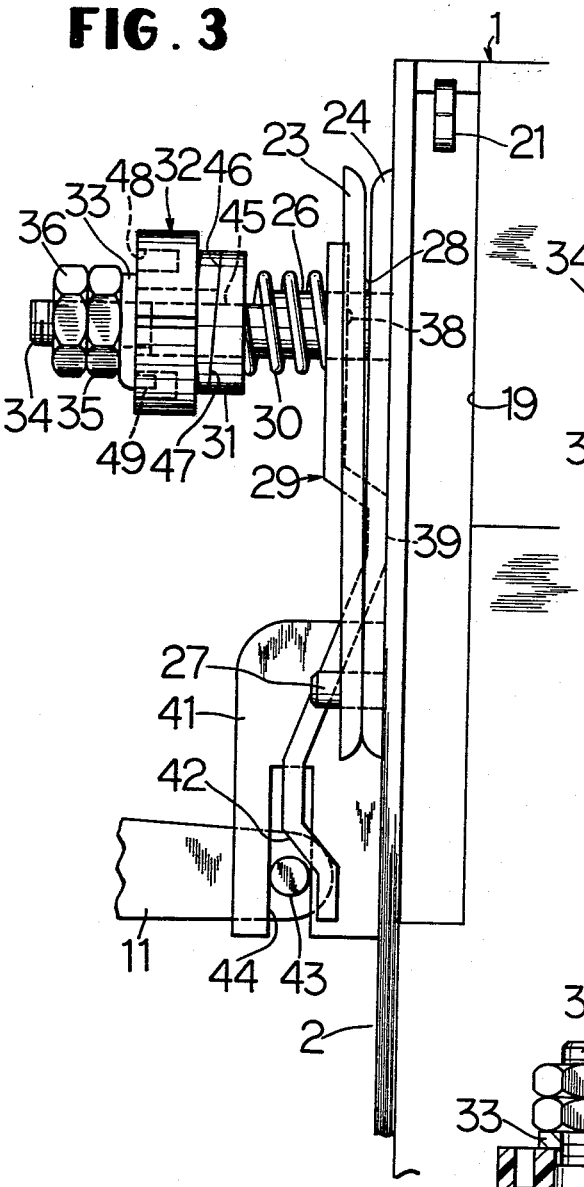
FIG. 3 is an enlarged side view of FIG. 2.

As for the upper thread T drawn out from the supply of upper thread; it is led, guided by the first thread guide 12 and the guide pin 13, as shown in FIGS. 1 and 2, between that pair of elongated plate members 23, 24, and led after having been bent around the supporting shaft 26 to the pin 25 out of the gap between plate members 23, 24; at the second thread guide 15 it is turned back upwards for being bent downwards again, after having passed through the thread retaining eye 20 of the take-up lever 21, and finally led to the thread bore of the needle 4 via the third thread guide 17 and the fourth 18.

The thread T passes, being guided by the guide pin 13, the supporting shaft 26, and the pin 25, through the gap between both plate members 23 and 24 substantially along the elongated direction thereof.

Figure 4:
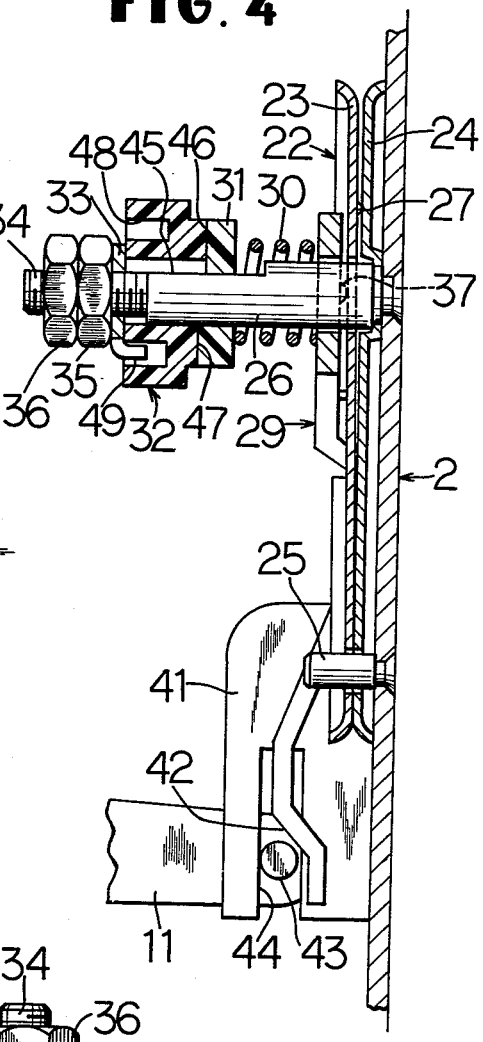
FIG. 4 is an enlarged side sectional view taken substantially along the line IV — IV of FIG. 2.
Figure 5:
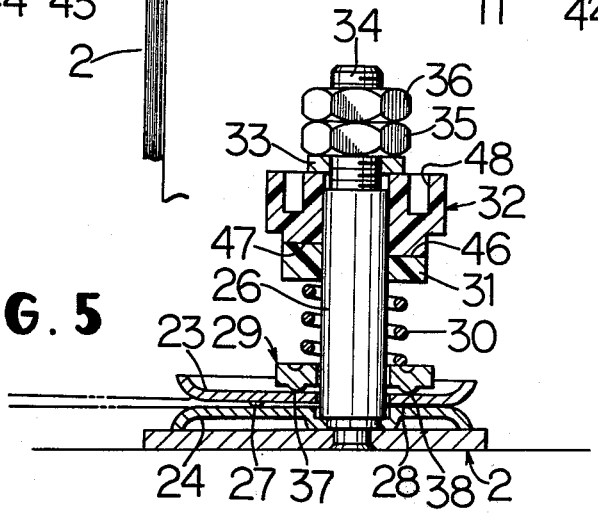
FIG. 5 is likewise an enlarged sectional view taken substantially along the line V — V of FIG. 2.

The gap between both plate members 23, 24, through which the route of the upper thread T turns, is because of existence of the pair of projections 27, 28, as best seen in FIG. 4, formed substantially wedge shape, being diverged toward the side of the supply of upper thread; and the gap between both plate members 23, 24 in the direction substantially normal to the passing route of the upper thread T is, because of difference of projection amount of that pair of projections 27, 28, as can be seen in FIG. 5, formed substantially wedge shape, being converged toward the outer side of the machine frame. The upper thread T drawn out from the supply of thread by the vertical movement of the take-up lever 21 is, therefore, allowed to smoothly pass through the gap between both plate members 23, 24 and can not slip out of the gap even if some slackening takes place in the thread between both plate members. The wedge-shaped gap formed between both plate members 23, 24 is, moreover, extremely thin or narrow, because the projection amount of the pair of projections 27, 28 are small, for example, the larger being 0.35mm and the smaller 0.2mm.

The actuating arm 29 is downwardly extending, with the intermediate portion being bent to form an abutment portion 39 onto the attaching plate 2, to be formed into a forked portion 40, which straddles the upper edge of a rising portion 41 formed by bending a part of the attaching plate 2, to prevent a random rotation of the actuating arm 29. At the lower end of the actuating arm 29 is formed a sloping portion 42 which serves as a cam, and a horizontally extending pin 43 fixed on the tip of the actuating arm 11, which is loosely fitted on the presser bar 8 at the base thereof and is engaged with the cam surface of the presser bar lifting lever 9 at the middle portion of the arm 11, passes through a vertically extending slot 44 formed in the rising portion 41, and confronts from beneath the sloping portion 42 of the actuating arm 29. When the presser bar 8 is lifted by the rotative operation of the presser bar lifting lever 9, the actuating arm 11 is also lifted in connection with the operation of the lever 9, resulting in a lifting of the horizontal pin 43 guided by the slot 44. The horizontal pin 43 will be then engaged with the sloping portion 42 of the actuating arm 29 to urge the same, with the result of counterclockwise rotating in FIGS. 3 and 4 of the actuating arm 29 around the abutment portion 39 as a fulcrum. This rotation will deprive the plate member 23 of the spring force of the compression spring 30 which has been urging thereon.

Furthermore, on the supporting shaft 26 is formed a flat surface 45; and the slider 31 is provided with a bore similar to the sectional shape of the supporting shaft 26 at the portion including the flat surface 45 for being fitted thereon, and is axially slidable but non-rotatable. On the front end surface 46 of the slider 31 is formed a circumferentially slanting cam surface for complementally engaging with a circumferentially slanting cam surface formed on the rear side surface 47 of the regulating knob 32; due to the rotational operation of the regulating knob 32 the slider 31 is axially moved to adjust the spring force of the compression spring 30. On the front surface of the regulating knob 32 is formed a circular groove 48 around the angular range of approximately 330°, whereinto being fitted a tongue 49 of a stopper 33 which is similarly to the slider 31 prevented from rotation.

As for the passing of the upper thread T through the wedge-shaped narrow gap between both plate members 23, 24 detailed description will be given referring to the diagrammatical drawings shown in FIGS. 6(*a*) to (*e*).

Figure 6:
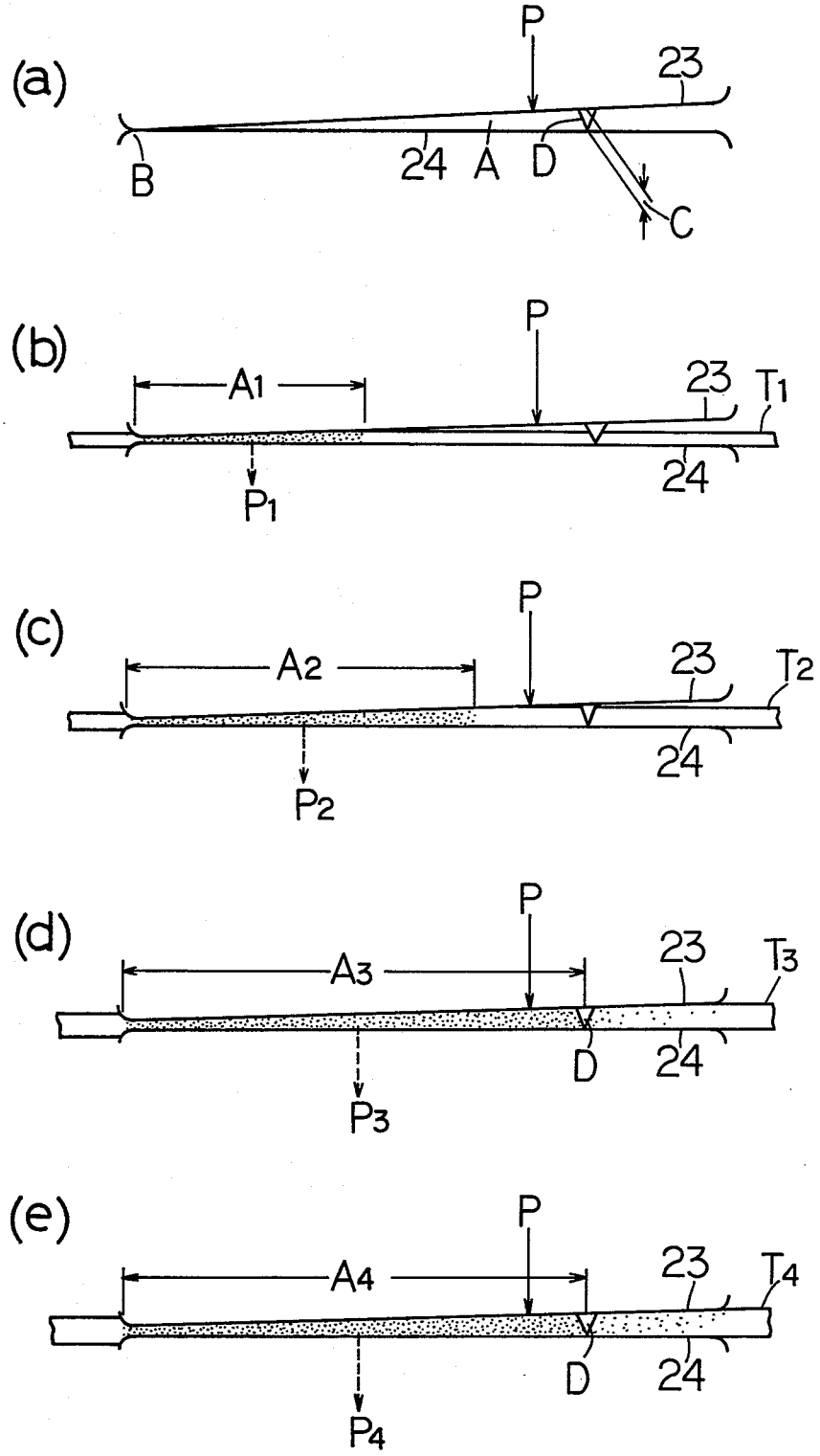
FIGS. 6(*a*) to (*e*) are all diagrammatic views for illustrating the basic principles of the upper thread tensioning device and FIG. 6(*a*) shows a condition in which no thread is passed, and FIGS. 6(*b*) to (*e*) shows conditions respectively wherein a thread of different size or thickness is passed.

The thread T is automatically imparted a predetermined tension in response to the size thereof while it passes through the wedge-shaped narrow gap provided between the confronting plate members 23, 24, which is illustrated in accordance with the principle of the device shown in FIGS. 6(*a*) to (*e*). The FIG. 6(*a*) indicates a state of both plate members 23, 24 wherein the upper thread is not passing, which members forming a wedge-shaped narrow gap A therebetween because of the existence of the pair of projections 27, 28, and contacting with each other at the point B. It is, therefore, thinkable that an imaginary projection D which forming a fixed clearance or gap C substantially exists in the gap A at a place corresponding to the position where the upper thread crosses the line linking the pair of projections 27, 28. And the movable plate member 23 can be assumed to move around the imaginary projection D as a fulcrum. The spring force of the compression spring 30 concentratedly acts on the movable plate member 23 through the pair or projections 37, 38 on the actuating arm 29, which being denoted by P in FIG. 6(*a*). This acting point corresponds to the position where the upper thread T crosses the line linking the pair of projections 37, 38, which being located at a place approximately 35mm away from the contact point B in this embodiment. And the fixed clearance gap C, that is the amount of projection of the imaginary projection D is about 0.25mm in this embodiment.

FIG. 6(*b*) represents a state wherein a super-thin thread $T_1$ passes between both plate members 23, 24, which thread contacts in the area $A_1$ with both plate members 23, 24 for receiving the action of spring force $P_1$ ranging the entire contacting range $A_1$. To the movement of the thread $T_1$ acts conversely a frictional resistance of the magnitude proportional to the compression force $P_1$ to impart to the thread a tension corresponding to that magnitude. When a medium-thin upper thread $T_2$ passes between both plate members 23, 24 the contacting range $A_2$ is, as shown in FIG. 6(*c*), expanded in comparison to the case of the super-thin thread $T_1$, so the thread $T_2$ receives a greater compression force $P_2$ than that $P_1$ in the previous case in the entire range $A_2$. This phenomenon can be likened to a lever principle wherein the fulcrum lies at D and the spring force P is assumed to be the force acted on the point of force; the nearer the point of action on the upper thread comes to the point of force, the larger force will it receive. In case of thread, unlike the case of rigid body, the point of action is not exactly fixed as a point but becomes an area or range of action in reality; the nearer the center of the range of action comes to the point of force, the larger becomes in a similar way the compression force acting on the upper thread. Therefore, a larger frictional resistance will act on the upper thread $T_2$ than in case of the upper thread $T_1$, and in turn, a relatively larger tension will be imparted.

When an upper thread $T_3$ of thicker standard than the upper thread $T_2$ passes between both plate members 23, 24, it is placed in contact with both plate members 23, 24 even on the side of the supply of upper thread beyond the projection D as shown in FIG. 6(*d*). In the portion, right side beyond the projection D in the Figure, of the upper thread supply side the spring force P is substantially inactive; the acting range of the spring force P on the upper thread $T_3$ is limited to $A_3$, which can be understood from the fact that the projection D is not lifted up at all. In this case the compression force $P_3$ which the upper thread $T_3$ receives in the range $A_3$ is larger than the compression force $P_2$ which the upper thread $T_2$ receives in the range $A_2$. It is self evident from the foregoing description that the larger tension is imparted to the upper thread $T_3$ than in case of the upper thread $T_2$.

A case in which further thick thread (thick or super thick thread) passes between both plate members 23, 24 is illustrated in FIG. 6(*e*), wherein the acting range $A_4$ of the compression force $P_4$ is substantially the same as the range $A_3$, and the compression force $P_4$ which the upper thread $T_4$ receives in the range is also substantially equal to the compression force $P_3$. However, the upper thread $T_4$ is imparted a larger tension, because a large resistance owing to deformation thereof is given unlike in case of the upper thread $T_3$. Explaining further in detail, there substantially exists a fixed gap C in the place where the projection D is; and in case an upper thread of larger thickness than the clearance or gap C passes, it is forced to pass there, the clearance or gap C, in a squashed or compressed state. The squashed amount becomes larger in response to the increase of thickness of the upper thread passing through the gap C. The increase of resistance due to the deformation of the upper thread $T_4$ makes a passing thereof through the fixed gap C hard, consequently the upper thread $T_4$ will receive a larger tension than in case of $T_3$.

In short, difference in thickness of the upper thread passing between both plate members 23, 24 brings about a difference in the acting range of the compression force P and consequently a difference in the frictional resistance acted on the upper thread as well as the resistance due to the deformation of the upper thread while passing through the fixed clearance. The frictional resistance and resistance caused by the deformation automatically determine the passing resistance imparted to the upper thread, while the same passes between both plate members 23, 24, in response to the thickness of the upper thread; as a result of this the upper thread is given a predetermined tension in accordance with the thickness. The thicker the upper thread which passes between both plate members 23, 24 is, the larger tension will be imparted thereto. The amplitude of this tension thus imparted largely depends upon the size of the fixed clearance or gap C, which needs to be determined upon considering the tension imparted to the upper thread at other portions in the route thereof, for example, the tension given by resistance generated while passing the thread guides 12, 15, 17, 18, etc.

It goes without saying that varying the spring force P will result in varying the tension given to the upper thread. A slight adjustment of tension by means of rotating the regulating knob 32 can be performed on occasion; and as the gap A between both plate members is extremely thin or narrow, so the acting range of the spring force P to the upper thread sensitively varies in response to the thickness of the upper thread T which passes through the gap A. Consequently it is a matter of course that the spring force acting on the upper thread is conspicuously varied to adjust the tension imparted thereto.

As stated above in greater detail, in this embodiment an upper thread which passes the gap between both plate members 23, 24 of the upper thread tensioning device is automatically given a predetermined tension in response to the thickness thereof, which has completely eliminated the trouble of having to adjust the tension of the upper thread upon execution of trial sewing whenever thread is changed. And the change of the upper thread is also to be performed extremely easily only by means of upward rotating of the presser bar lifting lever 9 which deprives the movable plate member 23 of the spring force of the compression spring 30 acting thereon. The gap formed between both plate members 23, 24 is larger on the side of supply of upper thread in the thread passing route, so that insertion of an upper thread therebetween can not fail; the wedge-shaped gap between the plate members 23, 24, which being diverged toward the side of thread supply, allows the thread to smoothly pass therethrough and to be imparted a stable tension. If the gap along the path of the upper thread should be, reverse to this embodiment, formed converged toward the side of thread supply, the movable plate 23 would be randomly moved, because the upper thread T would be suddenly squashed at the entrance of the gap between both plate members 23, 24, and the entrance end of the movable plate 23 is lifted up by a relatively small force. It would be difficult to impart a stable tension on the passing thread. As the gap between both plate members 23, 24 is of wedge like shape being converged toward the outer side of the machine frame away from the normal route of the upper thread, the upper thread T can not slip out of the normal route thereof shown in FIG. 2 but is always kept in a constant route for being imparted a stable tension.

This embodiment is a realization of the present invention in an upper thread tensioning device of household sewing machines; and it is well-known that the tension of the lower thread in this case requires little to be changed even when the thickness of a thread is varied. In some of industrial sewing machines, for example, in an overedge sewing machine or a chainstitch sewing machine, adjustment of lower thread tension affects forming of stitches almost as much largely as the adjustment of upper thread tension. The present invention can be likewise realized in a lower thread tensioning device for such sewing machines. One more important comment must be added as regards the processing of the plate members. In the abovementioned embodiment the fixed plate member 24 is independently disposed of the attaching plate 2; the latter 2 may be produced by pressing to simultaneously form the fixed plate member 24 integrally therewith, that is to press the attaching plate 2 and the fixed plate member as one piece by extending the attaching plate into a plate member for simplifying the process and the structure.

It will be obvious to those skilled in the art that various changes may be made without departing from the scope of the invention and the invention is not to be considered limited to what is shown in the drawings and described in the specification.

What is claimed is:

1. A thread tensioning device for a sewing machine having a frame, a stitch-forming instrumentality mounted on said frame, and thread guide means for providing a path of the thread from a supply source of the thread to said stitch-forming instrumentality, said thread tensioning device being mounted within said frame, and comprising:

a pair of elongated rigid plate members mounted on said frame and extending along the thread path;

biasing means for concentratedly applying pressure at a fixed point on one of said plate members and along the thread path, to bias said one plate member toward the other; and gap-forming means for forming a substantially wedge-shaped and extremely narrow gap, extending along the thread path, between said elongated plate members against said biasing means; and wherein said plate members contact one another at the ends thereof;

wherein said gap-forming means include projection means for forming a fulcrum for said one plate member at a point sufficiently away from the contacting ends of said plate members and on said thread path between said plate members, and for forming a fixed clearance, substantially at least equal to the size of standard thread, at said point on said thread path; and wherein said fixed point, at which said biasing means concentratedly applies pressure, lies in proximity to said fulcrum provided by said projection means;

whereby when the thread passes through said wedge-shaped gap during sewing operation, a suitable resistance force against movement of the thread is automatically established in response to the size of the thread by the tensioning device.

2. A thread tensioning device according to claim 1, wherein said wedge-shaped gap diverges toward the side of the thread supply source by said projection means, and one-side edges of said elongated plate members are adjacent to the exterior surface of said frame.

3. A thread tensioning device according to claim 2, wherein said tensioning device is mounted within the frame, and said wedge-shaped gap converges toward the outside of said frame in the direction across the thread path by said projection means.

4. A thread tensioning device according to claim 1, further comprising a manually operable member within said frame for optionally regulating the pressure of said biasing means.

5. A thread tensioning device for a sewing machine having a frame, a stitch-forming instrumentality mounted on said frame, and thread guide means for providing a path of the thread from a supply source of the thread to said stitch-forming instrumentality, said thread tensioning device being mounted within said frame, and comprising:

a pair of elongated rigid plate members mounted on said frame and extending along the thread path;

biasing means for concentratedly applying pressure at a fixed point on one of said plate members and along the thread path, to bias said one plate member toward the other; and gap-forming means for forming a substantially wedge-shaped and extremely narrow gap, extending along the thread path, between said elongated plate members against said biasing means; and wherein said plate members contact one another at the ends thereof;

wherein said gap-forming means include projection means for forming a fulcrum for said one plate member at a point sufficiently away from the contacting ends of said plate members and on said thread path between said plate members, and for forming a fixed clearance, substantially at least equal to the size of standard thread, at said point on said thread path;

wherein said fixed point, at which said biasing means concentratedly applies pressure, lies in proximity to said fulcrum provided by said projection means; and wherein said projection means comprises a pair of projections formed on either one of said plate members;

whereby when the thread passes through said wedge-shaped gap during sewing operation, a suitable resistance force against movement of the thread is automatically established in response to the size of the thread by the tensioning device.

6. A thread tensioning device for a sewing machine having a frame, a stitch-forming instrumentality mounted on said frame, and thread guide means for providing a path of the thread from a supply source of the thread to said stitch-forming instrumentality, said thread tensioning device being mounted within said frame, and comprising:

a pair of elongated rigid plate members mounted on said frame and extending along the thread path;

biasing means for concentratedly applying pressure at a fixed point on one of said plate members and along the thread path, to bias said one plate member toward the other; and gap-forming means for forming a substantially wedgeshaped and extremely narrow gap, extending along the thread path, between said elongated plate members against said biasing means; and wherein said plate members contact one another at the ends thereof;

wherein said gap-forming means include projection means for forming a fulcrum for said one plate member at a point sufficiently away from the contacting ends of said plate members and on said thread path between said plate members, and for forming a fixed clearance, substantially at least equal to the size of standard thread, at said point on said thread path;

wherein said fixed point, at which said biasing means concentratedly applies pressure, lies in proximity to said fulcrum provided by said projection means; and wherein said projection means comprises a pair of projections between said plate members, and one of said projections differs in height from the other;

whereby when the thread passes through said wedge-shaped gap during sewing operation, a suitable resistance force against movement of the thread is automatically established in response to the size of the thread by the tensioning device.

7. A thread tensioning device for a sewing machine having a frame, a stitch-forming instrumentality mounted on said frame, and thread guide means for providing a path of the thread from a supply source of the thread to said stitch-forming instrumentality, said thread tensioning device being mounted within said frame and comprising:

a stationary rigid plate member mounted fixedly on said frame and having one tensioning surface;

an elongated rigid plate member movably mounted opposite to said stationary plate member on said frame and having a second tensioning surface;

biasing means for concentratedly applying pressure at a fixed point on said elongated plate member and along the thread path, to bias said elongated plate member toward said stationary plate member, and gap-forming means for forming a substantially wedge-shaped and extremely narrow gap, extending along the thread path, between said plate members against said biasing means; and wherein said elongated plate member contacts at one end with said stationary plate member;

wherein said gap-forming means include projection means for forming a fulcrum for said elongated plate member at a point in said thread path between said plate members and away from the contacting end of said elongated plate member, and for forming a fixed clearance, substantially at least equal to the size of standard thread, at the point in the thread path; and wherein said fixed point, at which said biasing means concentratedly applies pressure, lies in the proximity of said fulcrum provided by said projection means;

whereby when the thread passes through said wedge-shaped gap during sewing operation, a resistance exerted to movement of the thread is automatically established in accordance with the size of the thread by the tensioning device.

8. A thread tensioning device for a sewing machine having a frame, a needle bar mounted on the frame for endwise reciprocation, a needle carried by the needle bar at the lower end, a thread take-up mechanism mounted on the frame for actuating in timed relation with said needle bar, an attaching plate secured to and within the frame, and thread guide means on the attaching plate for providing a path of the thread from a supply source of thread to the needle through the take-up mechanism, the thread tensioning device comprising:

a pair of elongated thread tensioning rigid plate members mounted on said attaching plate and extending along the thread path between said thread supply source and said take-up mechanism;

spring means for concentratedly applying pressure at a fixed point on one of said plate members and along the thread path, to bias said plate members toward said attaching plate; and gap-forming means for forming a substantially wedge-shaped and extremely narrow gap, extending along said thread path, between said elongated plate members against said spring means; and wherein said plate members contact with one another at these ends, wherein said gap-forming means include a pair of projections forming a fulcrum for one of said plate members at a point on the thread path between said plate members and sufficiently away from contacting ends of said plate members, and for forming a fixed clearance, substantially at least equal to the size of standard thread, at the point in said thread path, and wherein said fixed point, at which said spring means concentratedly applies pressure, lies in proximity of said fulcrum of said one plate member, formed by said pair of projections;

whereby when the thread drawn out from the thread supply source to the needle passes through the wedgeshaped gap during sewing operation, a resistance exerted to movement of the thread is automatically established in accordance with the size of the thread by said tensioning device.

9. A thread tensioning device for a sewing machine having a frame, a stitch-forming instrumentality mounted on the frame, and thread guide means for providing a path of the thread from a supply source of the thread to the stitchforming instrumentality, the thread tensioning device being mounted within the frame and comprising:

a pair of elongated rigid plate members, means for supporting said plate members to be closely confronted with each other, and including a supporting shaft and a pin parallel to said supporting shaft, one of said plate members having one tensioning surface and being stationary, and the other of said plate members having another tensioning surface and being movable, a compression spring mounted around said supporting shaft for concentratedly applying pressure to bias said movable plate member toward said stationary plate member, gap-forming means for forming a substantially wedgeshaped and extremely narrow gap, extending along the thread path, between said elongated plate members against said compression spring, said movable plate member contacting at one end with said stationary plate member, said supporting shaft lying away from the contacting end of said movable plate member, said gap-forming means including a pair of projections located close to said supporting shaft opposite said pin, said pair of projections forming a fulcrum for said movable plate member at a point in the thread path between said plate members and a little away from said supporting shaft, and forming a fixed clearance, substantially at least equal to standard thread, at said point in the thread path;

whereby when the thread passes through the wedge-shaped gap and in contact with the supporting shaft and the pin during sewing operation, a suitable resistance force against the movement of the thread is automatically established in response to the size of the thread by said tensioning device.

10. A thread tensioning device according to claim 9, further comprising a manually operable member rotatably mounted on said supporting shaft for regulating the pressure of said compression spring.

* * * * *